US005787676A

United States Patent [19]

Scharf

[11] Patent Number: 5,787,676

[45] Date of Patent: Aug. 4, 1998

[54] LUMBER STRAIGHTENING APPARATUS AND METHOD

[76] Inventor: Robert E. Scharf, 145 E. 200 South, Manti, Utah 84642

[21] Appl. No.: 819,278

[22] Filed: Mar. 18, 1997

[51] Int. Cl.[6] ..... E04B 2/70; E04G 21/18

[52] U.S. Cl. ..... 52/745.05; 52/749.1; 52/DIG. 1; 254/131

[58] Field of Search ..... 52/749.1, DIG. 1, 52/745.2, 745.05, 745.09; 254/131, 17; 294/15, 62, 92

[56] References Cited

U.S. PATENT DOCUMENTS

| | | | |
|---|---|---|---|
| 135,916 | 2/1873 | Houston | 254/17 |
| 483,571 | 10/1892 | Miller | 254/17 |
| 4,463,979 | 8/1984 | Lybolt | 294/62 |
| 4,750,252 | 6/1988 | Homeyer | 294/92 X |
| 4,762,303 | 8/1988 | Thomas | 254/131 X |
| 4,826,136 | 5/1989 | Thomas | 254/131 X |
| 4,856,834 | 8/1989 | Lancaster et al. | 294/92 |
| 5,165,659 | 11/1992 | L'Heureux | 254/17 |
| 5,382,000 | 1/1995 | Rossman | 254/17 |

*Primary Examiner*—Lanna Mai
*Assistant Examiner*—Kevin D. Wilkens
*Attorney, Agent, or Firm*—Foster & Foster

[57] ABSTRACT

A lumber straightening apparatus includes generally a force application section and a lumber engaging section. In a preferred application, the lumber engaging section is inserted over a stud being secured as part of a stud wall. Force is applied to the force application section to cause a first end of the stud to rotate relative to a second end of the stud. After rotation and upon positioning the first end in proper alignment and orientation relative to a cross piece, the first end is secured to a cross piece in a parallel and square manner relative to the cross piece.

19 Claims, 2 Drawing Sheets

LUMBER STRAIGHTENING APPARATUS AND METHOD

TECHNICAL FIELD

This invention relates to construction tools and methods, and more particularly, to tools methods used in the construction industry for ensuring the edification of true, straight walls.

BACKGROUND OF THE INVENTION

Speed and precision are the essence of any successful construction business. Numerous tools, techniques, and construction methods have been devised over the years to speed up construction of various phases, items, and other building projects. Although speed is important, equally important is the maintenance of high quality construction to satisfy customers.

One of the most basic elements of any construction project involving an edifice relates to the interior walls. Most commonly, stud walls are constructed on a flat, ground surface and subsequently erected and secured in place to form the upright walls of a building. In other words, the typical manner of constructing stud walls involves building the walls in a horizontal position on the ground and subsequently rotating the wall in an upright position and securing the pre-built wall in its proper location.

A problem commonly faced by framers (i.e., those construction workers involved in building stud walls) relates to maintaining the vertical studs completely square and true with respect to the horizontal cross pieces on the top and bottom of the stud wall (sometimes referred to as top and bottom plates). Lumber used to build stud walls commonly is twisted and requires repositioning of one end of the piece of lumber relative to another end of the piece of lumber to ensure that the mating boards are perpendicular and square with respect to each other. Otherwise, the vertical stud will be secured in a position that is not square with respect to the vertical cross piece. In such a situation, the end surfaces of the vertical stud and the horizontal cross piece will not be flush with one another (plane), which creates difficulties in applying other material to the stud wall, such as sheetrock.

The traditional manner of straightening and aligning twisted lumber used to construct walls is to secure one end of the stud in a properly aligned position to one of the horizontal cross pieces (either the top plate or the bottom plate). Thereafter, the opposite, unattached end is rotated by the construction worker (using the free hand which is not holding the hammer) until the free end is square relative to and properly aligned with the opposed cross piece. Any twist in the lumber will immediately be noticeable because the free end of the stud being attached will not be completely square or flush with the corresponding surfaces of the cross piece. Thereafter, the construction worker will drive in nails or other fasteners while holding the stud in the properly aligned position. This method is quite cumbersome, however, because the nails must be driven through the top or bottom plate with one hand holding the stud in place. In addition, this typically requires starting the fasteners into the top or bottom plate before orienting the free end of the stud in the properly aligned position.

Accordingly, there is a need for a new device and method that will assist the construction worker in positioning and straightening lumber used to construct floors and stud walls in framing buildings. There is also a need for a method and device for constructing stud walls that will free up both hands of the construction worker for constructing the stud wall.

SUMMARY AND OBJECTS OF THE INVENTION

It is, therefore, a primary object of the present invention to provide a lumber straightening apparatus that enables a piece of lumber used in constructing a wall, ceiling, or a floor to be straightened without the use of a construction worker's hands prior to securing the piece of lumber in place in the wall.

Another object of the invention is to provide a lumber straightening apparatus that can be used by the construction worker, yet allow both of the construction worker's hands to remain free to build a wall, ceiling, or floor.

Yet another object of the invention is to provide a lumber straightening apparatus and method that utilizes force placed on the apparatus from a foot, knee, or other body portion of a construction worker to straighten lumber used to construct a wall, ceiling, or floor.

Still another object of the invention is to provide a lumber straightening apparatus that will straighten radically twisted pieces of lumber (either a top or bottom plate) in a square, properly aligned, and flush manner relative to a cross piece (either a top or bottom plate) of the stud wall.

The foregoing objects are achieved by a lumber straightening apparatus and method that includes a force application section and a lumber engaging section coupled to the force application section. The lumber engaging section includes at least a portion that pulls on an area of the piece of lumber being straightened and at least a portion in an opposed relationship relative to the pulling portion that pushes an area of the piece of lumber to cause the lumber to twist and become straight relative to a cross piece to which the stud will be attached. The force application section is intended to receive a force applied by the foot, knee, or other body portion of the construction worker so that the construction worker's hands are free to build the wall, floor, or ceiling.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

FIGS. 1–5 show a lumber straightening apparatus 10 according to the present invention. The lumber straightening apparatus is generally comprised of a force application section 12 and a lumber engaging section 14.

Figure 1:
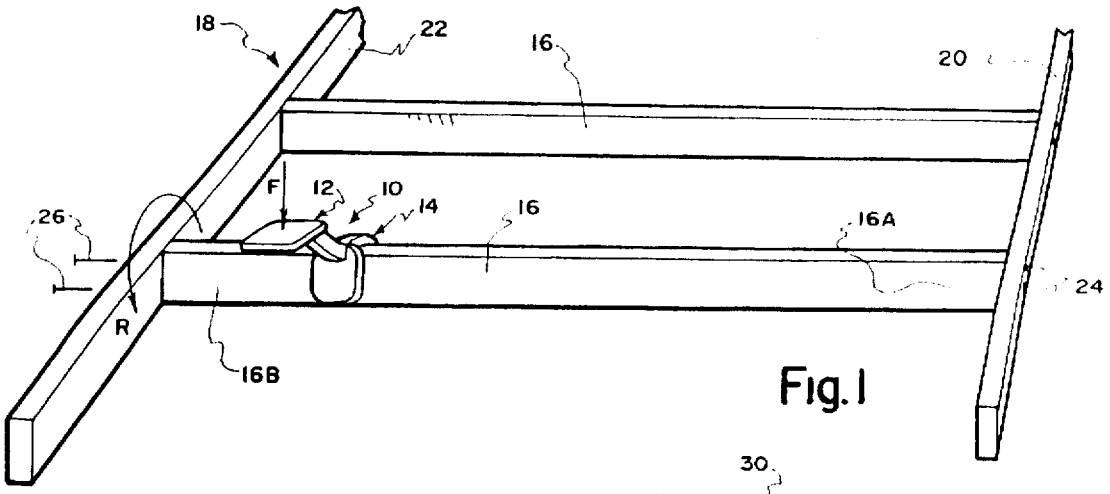
FIG. 1 is an isometric view of a stud wall being constructed utilizing a lumber straightening apparatus according to the present invention.

FIG. 1 shows the lumber straightening apparatus 10 inserted over a piece of lumber 16 which may form part of a wall, ceiling, or floor structure 18. In a preferred embodiment, the structure 18 comprises a stud wall having vertical studs 16 (only two shown) and cross pieces 20, 22 for securing to each side of the vertical studs 16. The cross pieces 20, 22 form a bottom plate and a top plate, respectively, of the stud wall. It is to be understood that the lumber straightening apparatus and method of the present invention may be used to straighten lumber used in building any portion of an edifice, including without limitation floors, ceilings, walls, trusses, and the like. For convenience purposes only, the following discussion will address the structure 18 shown in the drawings as if it were a stud wall. The scope of the invention is not to be limited, however, to applications involving stud walls only.

Typically, a stud wall 18 will be constructed on the ground (as shown in FIG. 1) to ensure that the wall is squarely constructed and to facilitate construction of the wall. Thereafter, the wall is erected and secured in place to form a wall of a building or other edifice. In constructing the wall on the ground, studs 16 are properly spaced relative to one another and secured to the bottom plate 20 (as shown in FIG. 1) in their respective proper positions. Typically, only one stud is attached at a time, usually starting from an end of the stud wall and working toward the other end. The stud is secured to the bottom plate 20 using conventional fasteners, such as nails 24. After a first end 16*a* of the stud 16 is secured to the bottom plate 20 (or alternatively the top plate 22), the other, second end 16*b* of the stud remains unattached to the wall structure 18. Since the first end 16*a* is secured in presumably a properly oriented and aligned position, any twist or irregularity in the stud will be noticed immediately by the position of the second, unattached end 16*b* .

To properly align and secure the second, unattached end 16*b* of the stud 16 in proper position to the top plate 22 (i.e., with the stud end 16*b* oriented perpendicularly and squarely relative to the top plate 22), the lumber straightening apparatus 10 is placed over a first portion of the lumber near the second, unattached end of the stud. The second end 16*b* (or the first portion) of the stud 16 is then twisted, maneuvered, and positioned relative to the first end 16*a* (or the second portion) by applying force F (shown by Arrow F in FIG. 1) to the lumber straightening apparatus. As explained below, force can be applied by a leg, foot, knee, or other body portion, thus leaving both hands of the construction worker free to perform other work associated with constructing the stud wall. The force F applied to the lumber straightening apparatus will cause the second end to rotate in the direction R as shown in FIG. 1. If rotation is desired in a direction opposite to what is shown in FIG. 1, the lumber straightening apparatus is removed, rotated 180 degrees, and reinserted over the stud. Rotation will thus occur toward the direction of the force application section 12. Although the device 10 is shown rotating a piece of lumber on a flat surface, it should be understood that the device could be used in any position to straighten any piece of lumber.

As explained, a force F applied to the force application section 12 will cause the stud to rotate and become reoriented in the manner shown by arrow R. Once the vertical stud has been properly oriented so that it is squarely and perpendicularly positioned relative to the top plate cross piece 22, conventional fasteners 26, such as nails or screws, are driven through the top plate cross piece 22 and into end of the vertical stud 16 to hold the stud in the preferred position. As is conventional, after the stud wall 18 has been fully constructed, it is elevated from a horizontal position to a vertical position and secured in its proper place within a wall of an edifice.

Figure 2:
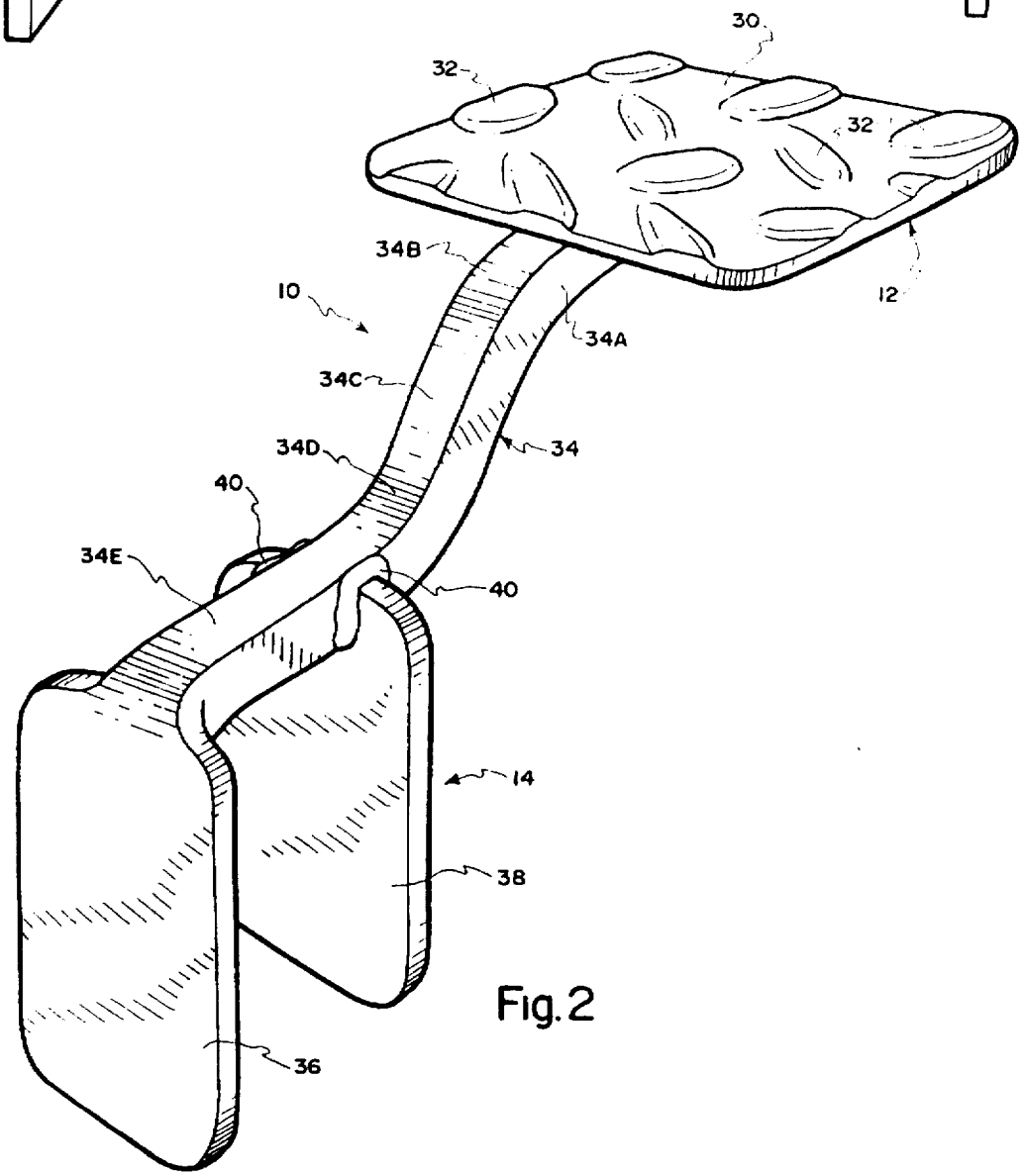
FIG. 2 is a rear isometric view of a lumber straightening apparatus according to the present invention.

FIGS. 2–5 show additional details of one embodiment of a lumber straightening apparatus 10 according to the present invention. As shown in FIG. 2, the force application section 12 comprises a foot plate or platform 30 sized for applying force by a knee, foot, or other part of a person using the apparatus. The platform 30 includes a plurality of raised, anti-slip nodules 32 for providing increased friction between the platform and a knee or foot applying force to the lumber straightening apparatus. Most commonly, a construction worker's foot will engage the foot plate 30 to rotate the stud into the proper position.

Figure 3:
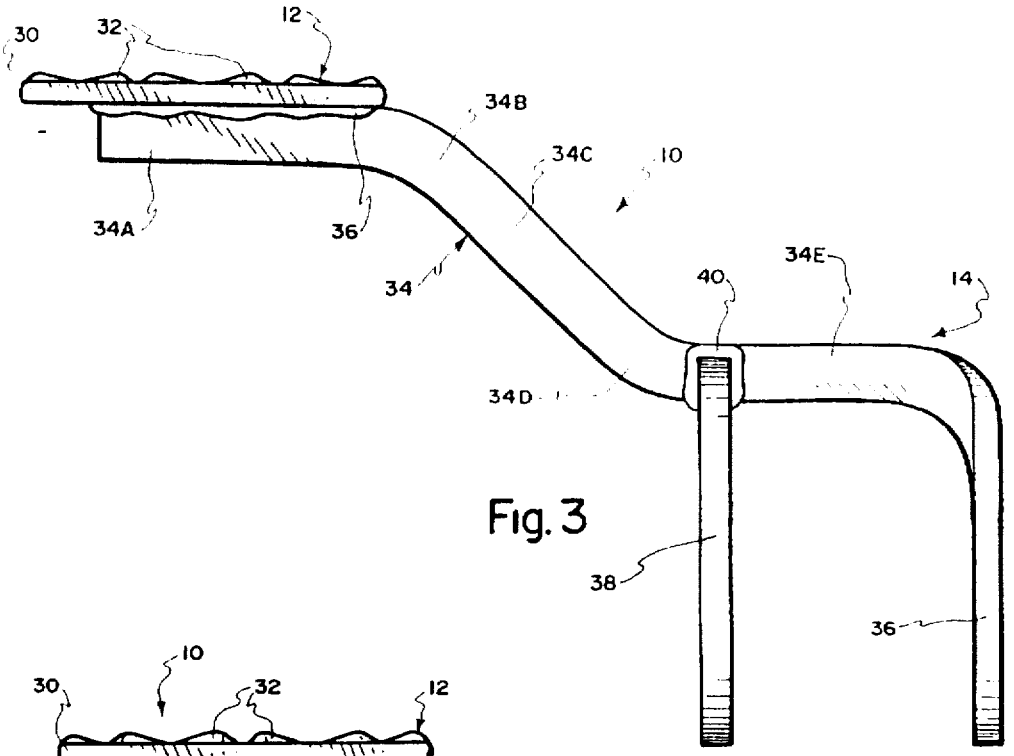
FIG. 3 is a side elevation view of the lumber straightening apparatus of FIG. 2.
Figure 4:
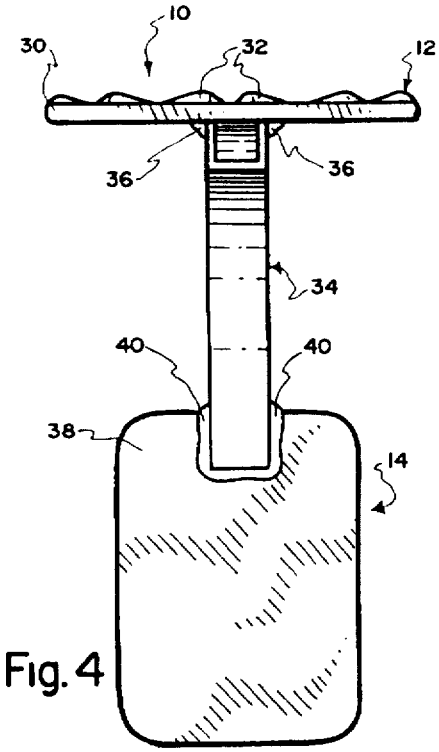
FIG. 4 is a front elevation view of the lumber straightening apparatus of FIG. 2.
Figure 5:
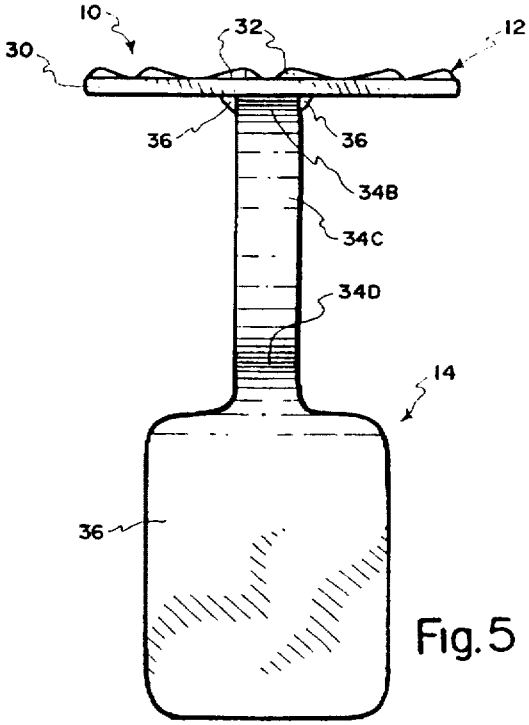
FIG. 5 is a rear elevation view of the lumber straightening apparatus of FIG. 2.

The foot plate 30 is attached to a lever arm 34 by any conventional means. FIGS. 3–5 show opposed welds 36 which hold the foot plate 30 in position on the lever 34. The lever 34 is contoured beginning with a relatively horizontal section 34A, which leads to a first transition section 34B which then leads to a angled straight section 34C, a second transition section 34D, and a second horizontal section 34E. The lever 34 terminates at a distal paddle-like member 36. It is to be understood that although the lever arm 34 is continuous in the embodiment show in FIGS. 1–5, the lever arm may comprise various components fastened together in any desired manner without departing from the scope of the present invention. The paddle member 36 coupled to the lever arm comprises a pulling leg (i.e., the pulling side) which effectively pulls on the top portion of the piece of lumber (in the direction noted in FIG. 1) at the particular location where the lumber straightening apparatus is mounted, closer to the unsecured end 16*b* of the stud as compared to the secured end 16*a*.

A proximal paddle-like member 38 is secured to the second horizontal section 34E of the lever arm 34. The paddle member 38 comprises a pushing leg. Any conventional fastening means may be used to secure the paddle member 38 to the lever arm 34. In this particular embodiment, a pair of opposed welds 40 are used to secure the paddle member 38 in position on the lever arm 34. The pushing leg (i.e., the pushing side) urges a bottom portion of the piece of lumber to rotate in a direction away from the force application section (in the direction shown in FIG. 1) to achieve the desired alignment of the unsecured end of the stud relative to the secured end.

It can be seen that the paddle members 36, 38 are solid, flat pieces of material in one embodiment. These members may be hollow, or may include openings, for a preferred reduction in weight in the lumber straightening apparatus. The paddle members are generally longer than they are wide. It is to be understood, however, that other configurations and cross-sectional shapes of the various members used in connection with the lumber straightening apparatus 10 may be used without departing from the scope of the present invention. Preferably, the material used to construct the lumber straightening apparatus will be made of steel, but other materials may likewise be used, such as, without limitation, other metals, plastic, and the like.

In compliance with the statute, the invention has been described in language more or less specific as to structural and methodical features. It is to be understood, however, that the invention is not to be limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

I claim:

1. A method of straightening a piece of lumber, comprising the steps of:

providing a piece of lumber having a first end and a second end;

securing the first end of the piece of lumber to a cross piece;

providing a lumber straightening apparatus, comprising:

a lumber engagement section to hold the second end of the piece of lumber;

a force application section coupled to the lumber engagement section to allow application of force to the force application section;

a pressure plate coupled to the force application section to allow force to be applied to the force application section;

applying force to the pressure plate and consequently to the force application section to cause the second end of the piece of lumber to move relative to the first end of the piece of lumber.

2. The method of claim 1 further comprising the step of securing the second end of the piece of lumber to another cross piece, moving the second end of the piece of lumber relative to the first end of the piece of lumber.

3. The method of claim 1 wherein the step of securing the piece of lumber comprises attaching the first end to a lumber cross piece to form a portion of a stud wall.

4. The method of claim 1 wherein the step of securing the piece of lumber comprises attaching the first end to a first lumber cross piece to form a portion of a stud wall, and further comprising the step of securing the second end of the piece of lumber to a second cross piece after moving the second end of the piece of lumber relative to the first end of the piece of lumber.

5. The method of claim 1 wherein the step of securing the piece of lumber comprises attaching the first end to a first lumber cross piece such that the first end is square and perpendicular with respect to the first lumber cross piece to form a portion of a stud wall, and further comprising the steps of:

using the lumber straightening apparatus to position the second end of the piece of lumber such that the second end is square and perpendicular with respect to a second lumber cross piece;

securing the second end of the piece of lumber to the second lumber cross piece after positioning the second end of the piece of lumber relative to the first end of the piece of lumber.

6. A lumber straightening apparatus, comprising:

a lumber engaging section to hold a first portion of a piece of lumber;

a force application section coupled to the lumber engaging section;

a platform having a flat surface coupled to the force application section such that when force is applied to the force application section through the platform the first portion of the piece of lumber moves relative to a second portion of the piece of lumber.

7. A lumber straightening apparatus according to claim 6, further comprising a lever arm interconnecting the lumber engaging section and the force application section, the lever arm providing a mechanical advantage to assist in straightening a piece of lumber to be secured in a building structure.

8. A lumber straightening apparatus according to claim 6 wherein the lumber engaging section comprises a pulling leg and a pushing leg, the pulling leg and the pushing leg being insertable over the first portion of the piece of lumber such that the pushing leg pushes on the first portion of the piece of lumber and the pulling leg pulls on the first portion of the piece of lumber when the first portion is moved relative to the second portion.

9. A lumber straightening apparatus according to claim 6 wherein the lumber engaging section comprises a pulling leg and a pushing leg, the pulling leg and the pushing leg comprising paddle-like members.

10. A lumber straightening apparatus according to claim 6 wherein the platform sized for applying force by a knee or a foot.

11. A lumber straightening apparatus according to claim 6 wherein the platform includes an anti-slip top surface, the platform being sized for applying force by a knee or a foot, the anti-slip surface increasing friction between the platform and a knee or a foot, applying force the lumber straightening apparatus.

12. A lumber straightening apparatus according to claim 6 wherein the platform comprises a top surface and a plurality of anti-slip nodules formed on the top surface, the platform being sized for applying force by a knee or a foot, the anti-slip nodules increasing friction between the platform and a knee or a foot applying force to the lumber straightening apparatus.

13. A lumber straightening apparatus, comprising:

a lumber engagement section including a pulling side and a pushing side, the lumber engaging section sized to be inserted over a first portion of a piece of lumber;

a force application section including a lever arm coupled to and extending from the lumber engagement section and a pressure plate attached to the lever arm to allow force to be applied to the force application section such that when force is applied to the force application section the first portion of the piece of lumber moves relative to a second portion of the piece of lumber.

14. A lumber straightening apparatus according to claim 13 wherein the pulling side and the pushing side are sized for insertion over the first portion of the piece of lumber such that the pushing side pushes on the first portion of the piece of lumber and the pulling side pulls on the first portion of the piece of lumber when the first portion is moved relative to the second portion.

15. A lumber straightening apparatus according to claim 13 wherein the pulling side comprises a first paddle-like member and the pushing side comprises a second paddle-like member, the pulling side and the pushing side being sized for insertion over the first portion of the piece of lumber such that the pushing side pushes on the first portion of the piece of lumber and the pulling side pulls on the first portion of the piece of lumber when the first portion is moved relative to the second portion.

16. A lumber straightening apparatus according to claim 13 wherein the pulling side comprises a first paddle-like member integrally extending from the lever arm and the pushing side comprises a second paddle-like member coupled to the lever arm, the pulling side and the pushing side being sized for insertion over the first portion of the piece of lumber such that the pushing side pushes on the first portion of the piece of lumber and the pulling side pulls on the first portion of the piece of lumber when the first portion is moved relative to the second portion.

17. A lumber straightening apparatus according to claim 13 wherein the pressure plate is sized for applying force by a knee or a foot.

18. A lumber straightening apparatus according to claim 13 wherein the pressure plate includes an anti-slip top surface, the pressure plate being sized for applying force by a knee or a foot, the anti-slip surface increasing friction between the pressure plate and a knee or a foot applying force to the lumber straightening apparatus.

19. A lumber straightening apparatus according to claim 13 wherein the pressure plate has a top surface and includes a plurality of anti-slip nodules formed on the top surface, the pressure plate being sized for applying force by a knee or a foot, the anti-slip nodules increasing friction between the pressure plate and a knee or a foot applying force to the lumber straightening apparatus.

* * * * *